US005419394A

United States Patent [19]

Jones

[11] Patent Number: 5,419,394

[45] Date of Patent: May 30, 1995

[54] TOOLS FOR DELIVERING FLUID TO SPACED LEVELS IN A WELLBORE

[75] Inventor: Lloyd G. Jones, Dallas, Tex.

[73] Assignee: Mobil Oil Corporation, Fairfax, Va.

[21] Appl. No.: 155,513

[22] Filed: Nov. 22, 1993

[51] Int. Cl.[6] ..... E21B 43/04

[52] U.S. Cl. ..... 166/51; 166/233; 166/242

[58] Field of Search ..... 166/51, 276, 115, 116, 166/233, 242, 308

[56] References Cited

U.S. PATENT DOCUMENTS

| | | | |
|---|---|---|---|
| 971,612 | 10/1910 | Holliday | 166/372 |
| 3,090,316 | 5/1963 | Montgomery | 166/372 |
| 3,952,804 | 4/1976 | Smyrl | 166/278 |
| 4,506,729 | 3/1985 | Davis, Jr. et al. | 166/242 |
| 4,932,474 | 6/1990 | Schroeder, Jr. et al. | 166/51 X |
| 4,945,991 | 8/1990 | Jones . | |
| 5,018,575 | 5/1991 | Parsons | 166/242 |
| 5,082,052 | 1/1992 | Jones et al. . | |
| 5,113,935 | 5/1992 | Jones et al. . | |
| 5,161,618 | 11/1992 | Jones et al. . | |
| 5,165,476 | 11/1992 | Jones | 166/51 X |
| 5,269,375 | 12/1993 | Schroeder, Jr. | 166/278 |

OTHER PUBLICATIONS

Baker Packers—Flow Control Systems, Model "L" Sliding Sleeve; p. 880, Composite Catalog 1982–1983.

*Primary Examiner*—Ramon S. Britts
*Assistant Examiner*—Frank S. Tsang
*Attorney, Agent, or Firm*—Alexander J. McKillop; George W. Hager, Jr.; Lawrence O. Miller

[57] ABSTRACT

A well tool for delivering fluid (e.g. sand or gravel slurry) to different levels within a wellbore which is comprised of a delivery conduit which, in turn, has a plurality of exit ports spaced along its length. Each exit port has an exit tube connected thereto. Each exit tube includes a portion whose length lies substantially parallel to the longitudinal axis of the delivery conduit which permits larger exit ports to be used which, in turn, substantially reduces the likelihood of an exit port becoming blocked prior to completion of a well operation. Also, where at least a portion of an exit tube is inside the delivery conduit, the concentration of the sand flowing through the exit tube will be substantially the same as the original concentration in the slurry since sand particles will not tend to by-pass an exit port and remain in the slurry. This prevents the premature dehydration of the slurry and the resulting buildup of sand within the delivery conduit which is normally associated therewith.

19 Claims, 5 Drawing Sheets

TOOLS FOR DELIVERING FLUID TO SPACED LEVELS IN A WELLBORE

DESCRIPTION

1. Technical Field

The present invention relates to a well tool for delivering fluid to different levels in a wellbore and in one aspect relates to a well tool having improved exit ports for simultaneously delivering a particle-laden slurry to a plurality of different levels in a wellbore.

2. Background Art

Recently, a series of well tools have been proposed for simultaneously delivering fluids (e.g. fracturing fluids, gravel slurries, treating fluids, etc.) through alternate flowpaths to a plurality of different levels in a wellbore to carry out a particular well operation. For example, a well tool has been proposed for producing multiple fractures in a single operation within a wellbore. This tool is carried on the lower end of a workstring and has a plurality of exit ports or openings which are spaced to lie adjacent the respective zones of the wellbore which are to be fractured when the tool is in its operable position within the wellbore. For a further description of such a tool and its operation, see U.S. Pat. No. 5,161,618.

Another well tool of this general type is one which delivers a gravel slurry to spaced intervals around a well screen during a gravel-pack completion operation. This tool is comprised of one or more conduits or "shunt tubes" which are carried on the well screen and which extend longitudinally along the screen's axis. Each shunt tube has a plurality of exit ports or openings which are spaced along its length to simultaneously deliver a gravel slurry to a plurality of different levels of the annulus surrounding the screen. This provides a good distribution of the gravel across the entire annulus even if "sand bridges" occur in the annulus before the gravel placement is completed. For details of such a well tool and a further explanation of its operation, see U.S. Pat. Nos. 4,945,991; 5,082,052; and 5,113,935. For an example of a well tool capable of simultaneously delivering a treating fluid to different levels in a wellbore, see U.S. Pat. No. 5,161,613.

In tools of this type, problems may arise in maintaining adequate and consistant flow of fluid through the relatively small exit ports at each of the delivery points along the length of the tool. This is especially true where the fluid, e.g. slurry, is laden with particulate material, e.g. sand and/or gravel or the like as is normally the case in fracturing and/or gravel packing operations.

For example, the flow of the gravel-laden slurry in a gravel pack operation is substantially parallel to the axis of the delivery or shunt tubes until the slurry reaches the respective exit ports along the length of a shunt tube. The flow must then make a "right-angle" turn before it can flow through a respective exit port. This results in a tendency for at least some of the pariculates (i.e. sand), which are finite in size and denser than the carrier fluid, to by-pass the ports and remain in the parallel flow within the shunt tool. This, in turn, causes the sand concentration of the carrier fluid to build-up inside the delivery or shunt tube which may produce "sand bridges" therein thereby adversely affecting the distribution of the gravel pack throughout the annulus surrounding the screen.

In known prior art well tools of this type, this problem may be alleviated by changing the (a) sand density, (b) sand concentration, (c) the size of the particles, (d) the pump rates, (e) the fluid properties of the slurry, and/or (f) by reducing the number of exit ports in a particular tube. However, any of these solutions could substantially detract from the efficiency of the overall gravel-pack completion.

A similar problem exists in well tools of this type which are used to produce multiple fractures from a single wellbore. That is, since the direction of flow through the tool is perpendicular to the flow through each of the exit ports, at least a portion of any particles (e.g. sand) in the fracturing fluid will have the same tendency to by-pass the exit ports and build-up within the delivery conduit of the tool. This results in a diluted fracturing fluid (i.e. lower concentration of sand) being delivered through the exit ports. Still further, in order to maintain the proper pressures at each level along the tool and to prevent premature dehydration of the slurry, each of the exit ports must be relatively small. Unfortunately, the small size (e.g. diameter) of the exit ports severely restricts the volume of fracturing fluid which can be delivered to each fracturing level thereby further adversely affecting the fracturing operation.

SUMMARY OF THE INVENTION

The present invention provides a well tool for delivering fluid (e.g. sand or gravel slurry) to different levels within a wellbore during a well operation (e.g. fracturing and/or gravel packing a zone(s) within the wellbore) . Basically, the well tool is adapted to be fluidly connected to the lower end of a workstring and is comprised of a delivery conduit which, in turn, has a plurality of exit ports spaced along its length. Each exit port has an exit tube connected thereto; each exit tube having a portion whose length lies substantially parallel to the longitudinal axis of the delivery conduit.

The use of the exit tubes allows the exit ports in the delivery conduit to be larger in area which, in turn, substantially reduces the likelihood of an exit port becoming blocked with sand prior to the completion of the operation. Also, where the parallel length of an exit tube is inside the delivery conduit, the concentration of the sand flowing through the exit tube will be substantially the same as the original concentration in the slurry since the sand particles in the slurry will not tend to by-pass an exit port and remain in the slurry. This prevents the premature dehydration of the slurry and the resulting buildup of sand within the delivery conduit which is normally associated therewith.

More specifically, the present well tool is one which may be used to fracture and/or gravel pack one or more zones within a wellbore. The well tool is adapted to be connected to a workstring and is comprised of a delivery conduit which, in turn, may be comprised of a plurality of pipe joints which are connected together by special couplings. Each coupling has at least one exit tube formed therein. Each exit tube, in turn, is comprised of (a) an inlet passage or portion which preferably extends substantially parallel to the longitudinal axis of the delivery conduit and (b) an outlet which is substantially perpendicular thereto. Since the inlet portion of each exit tube is substantially parallel to the flow through delivery conduit, the fluid flowing through the delivery conduit will enter the exit tubes with little turbulence thereby alleviating the tendency for particles (sand) in the slurry to by-pass the exit ports and buildup in the delivery conduit.

Further, since the exit tubes provide direct conduits for the sand-laden fluid to reach the well annulus, the length of the tubes (e.g. may range up to several feet) allows the size (e.g. diameter) of the radial exit ports to be substantially increased so that larger volumes of fluid can be delivered at each level while still maintaining a good diversion or supply of fluid to all exits within the delivery conduit. The effective length of each tube may be further increased by adding an additional length of exit tube externally of the delivery conduit which extends substantially parallel to the longitudinal axis of the conduit.

The total length of the exit tubes is such that each tube will continue to provide easy access of slurry into the well annulus until a "sand-off" or "sand bridge" occurs in the annulus at a level adjacent a particular exit tube(s). When this occurs, a column of sand builds-up within that particular exit tube(s) until further flow through these exit tubes is blocked. Once plugged by a column of sand, there is no longer a sufficient pressure drop across the blocked tube to produce even liquid flow therein thereby preventing premature dehydration of the slurry and/or sand build-up within the delivery conduit.

The present well tool may also includes means for "unloading" the tool so that it can be retrieved from the wellbore upon the completion of an operation, if desired, while, in another embodiment, means are provided for closing flow through the exit tubes upon the completion of a well operation.

BRIEF DESCRIPTION OF THE DRAWINGS

The actual construction, operation, and apparent advantages of the present invention will be better understood by referring to the drawings in which like numerals identify like parts and in which.

BEST KNOWN MODE FOR CARRYING OUT THE INVENTION

Figure 1:
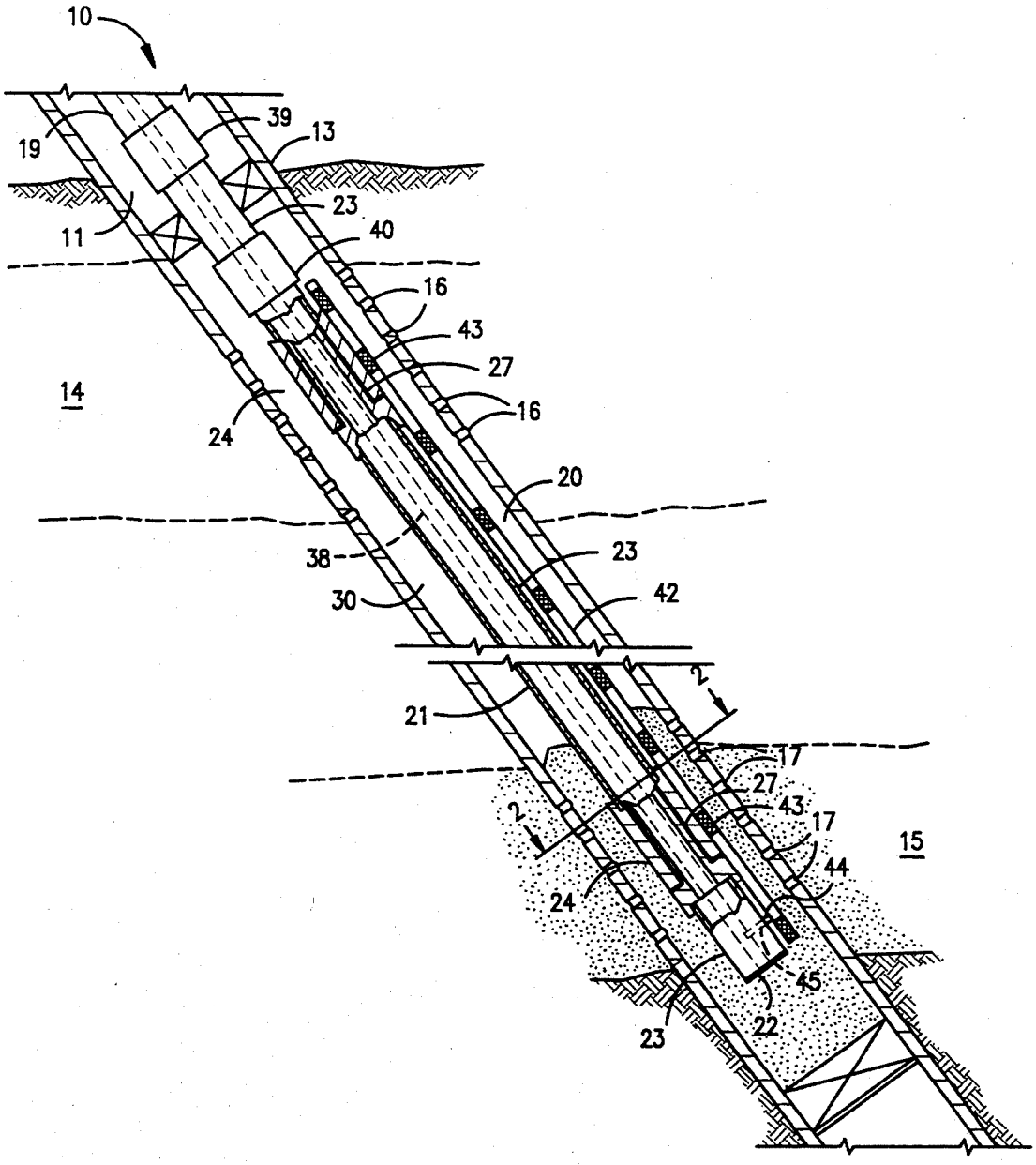
FIG. 1 is an elevational view, partly in section, of a well tool having alternate flowpaths in accordance with the present invention which is used in producing multiple fractures from a wellbore.

Referring more particularly to the drawings, FIG. 1 illustrates a well tool 20 in accordance with the present invention which is used to produce multiple fractures from the lower end of a producing and/or injection well 10. Well 10 has a wellbore 11 which extends from the surface (not shown) through an interval to be fractured. Wellbore 11 is typically cased with a casing 13 which is cemented (not shown) in place. While FIG. 1 illustrates well 10 as having an inclined cased wellbore, it should be recognized that the present invention can equally be used in open-hole and/or underreammed completions as well as in vertical and horizontal wellbores, as the situation dictates.

As illustrated, the fracture interval is comprised of a plurality (only two shown) of zones 14, 15 which may have different break-down pressures. Casing 13 is perforated at different levels to provide at least two sets of perforations 16, 17 which lie substantially within zones 14, 15, respectively. Since the present invention is appliable in horizontal and inclined wellbores, the terms "upper and lower", "top and bottom", as used herein are relative terms and are intended to apply to the respective positions within a particular wellbore while the term "levels" is meant to refer to respective spaced positions along the wellbore.

Figure 2:
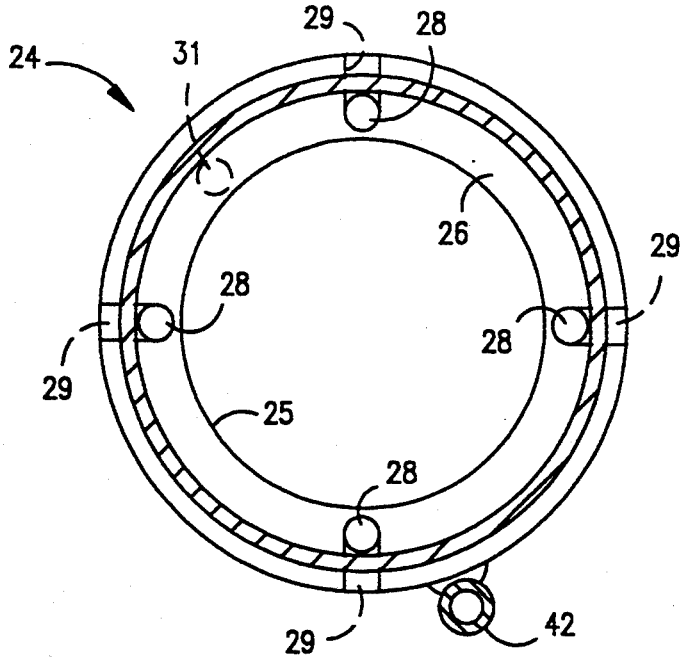
FIG. 2 is a sectional view taken along line 2—2 in FIG. 1.
Figure 7:
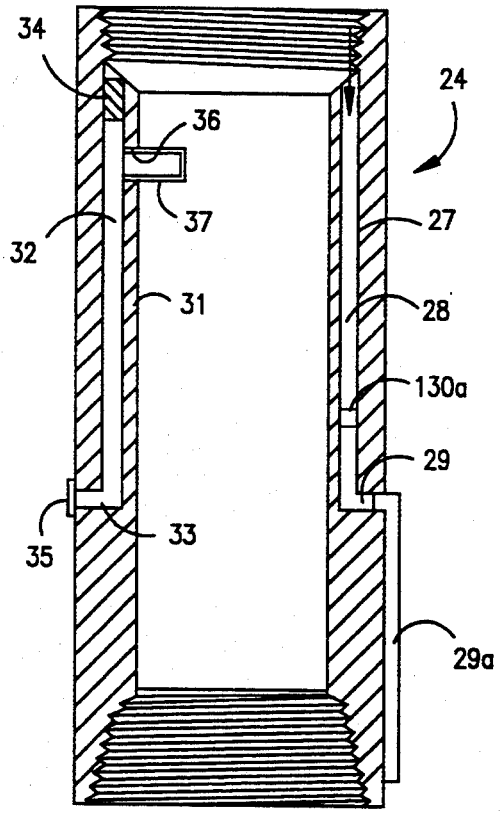
FIG. 7 is a sectional view of a coupling or collar having exit tubes therein for use in a well tool.

Well tool 20 is positioned in wellbore 11 substantially adjacent the interval to be fractured. Well tool 20 is connected to the lower end of a workstring 19 which extends to the surface (not shown) and is comprised of a delivery conduit 21 which may be either open or closed at its lower end 22. Conduit 21, in turn, is comprised of a plurality of joints or lengths of pipe 23 which are connected together by special couplings 24 (FIGS. 1, 2, and 7). Each coupling 24 is positioned so that it will lie substantially within a fracture zone(s) when tool 20 is in an operable position within wellbore 11.

Each coupling 24 is comprised of a housing having a reduced diameter 25 forming a shoulder 26 therein. At least one exit tube 27 (four shown in FIG. 2) is formed in each coupling. Each exit tube 27 comprises (a) an inlet passage or portion 28 which extends parallel to the longitudinal axis of the coupling and (b) an outlet passage or portion 29 which forms an exit port in delivery conduit 21 which is substantially perpendicular to inlet portion 28. Since the inlet portion 28 of each exit tube 27 has an inlet through the top of shoulder 26 and portion 28 is substantially parallel to the flow through conduit 21, slurry flowing through the delivery conduit will enter tubes 27 directly with little turbulence thereby alleviating the tendency for particles (sand) in the slurry to by-pass the tubes. The slurry flows into well annulus 30 through outlet passage or exit port 29 where it fractures the formation through respective perforations 16, 17.

Since exit tubes 27 also provide direct conduits for the fracturing fluid or slurry to reach annulus 30, the length of the tubes (e.g. may range up to several feet) allows the size (e.g. diameter) of the radial exit ports to be substantially increased so that larger volumes of fracturing fluid can be delivered at each level while still maintaining adequate pressures at each exit level while preventing undue liquid loss and premature dehydration of the slurry. The effective length of each exit tube 27 may be increased by connecting an additional length 29*a* (FIGS. 3 and 7) of exit tube to the radial exit port which extends substantially parallel to the longitudinal axis of the conduit externally thereof.

The overall length of an exit tube provides easy access of the fracturing fluid or slurry into annulus 30 until a "sand-off" or "sand bridge" (routinely associated with a fracturing and/or gravel pack operation) occurs in annulus 30 adjacent a particular exit tube(s) 27. When this occurs, a column of sand builds-up within these particular exit tube(s) until further flow through the tube(s) is blocked. Once plugged by a column of sand, the existing pressure drop across the blocked tube(s) is insufficient to produce any flow through the blocked tubes, not even flow of liquid from the slurry, thereby preventing premature dehydration of the slurry within the delivery conduit and the resulting sand build-ups therein.

Under normal operation, a particular exit tube 27 will plug with sand only after the adjacent annulus has been filled with sand and the well operation has been completed at that level. If, and when, a particular exit tube(s) is blocked by a column of sand, the slurry flowing through the delivery conduit 21 will be diverted to the other exit tubes which are still open to flow since flow through conduit 21 will remain open even after particular exit tubes 27 have become packed with sand. By spacing a plurality of exit tubes 27 along conduit 21, the flow of slurry is maintained through conduit 21 until the entire interval is fractured and/or gravel packed.

As will be understood by those skilled in this art, in some instances, it may be desirable to remove tool 20 from the wellbore upon the completion of the well operation. In a fracturing operation such as illustrated in FIG. 1, this may be difficult due to the sand which will remain in annulus 30 after the operation has been completed. In such instances, the wellbore may have to be "unloaded" before tool 20 can be retrieved from the hole. One way in which this may be accomplished is to provide additional "unloading" passages 31 in each of the couplings 24 (only one shown in FIG. 7).

This passage(s) 31 is formed in the same manner as are the exit tubes 27, i.e. passage 31 has an inlet portion 32 and an outlet portion 33. The upper entry into portion 32 is closed with plug 34 and a screen 35 or the like is provided across the outlet portion 33 to prevent sand from flowing into passage 31 from annulus 30.

An inlet 36 is provided to communicate the interior of coupling 24 with passage 31 and is initially closed by shearable, hollow plug 37 or a rupture disc, valve, or the like (not shown). When the fracturing operation is completed, a wash-pipe or the like (dotted lines 38 in FIG. 1) is lowered which will shear plugs 37 on the respective couplings 24 or, alternately, pressure is increased to rupture discs or the like to thereby open passages 31 for flow. A wash fluid (e.g. water) is pumped down the wash pipe and out into annulus 30 through passages 31 to wash and displace the sand upward in the annulus. Sliding sleeve valves 39, 40, (e.g. Model "L" Sliding Sleeve, distributed by Baker Packers, Houston, Tex.) which are closed during the fracturing operation but can be opened by a standard wire-line operations, are provided in conduit 21 to provide a cross-over or by-pass around packer 41 for the wash fluid and sand as the sand is "unloaded" from the annulus. Tool 20 and wash pipe 38 can then be retrieved from the wellbore 11.

Another way to unload the tool 20 after the completion of the fracturing operation is to provide an "unloading" tube 42 which extends parallel to and is mounted externally on tube 21 (FIGS. 1 and 2). Tube 42 has a plurality of fluid outlets which are protected by screens 43 or the like to prevent sand from flowing into the conduit during fracturing operations. Inlet 44 fluidly connects the interior of conduit 21 to tube 42 and is initially closed by shearable, hollow plug 45 or the like which is sheared upon the lowering of wash-pipe 38. Fluid from wash-pipe 38 will flow into tube 42 through inlet 44 and out screened outlets 43 to wash and displace the sand upward in annulus 30 to "unload" well tool 20 as will be understood by those skilled in this art.

Figure 3:
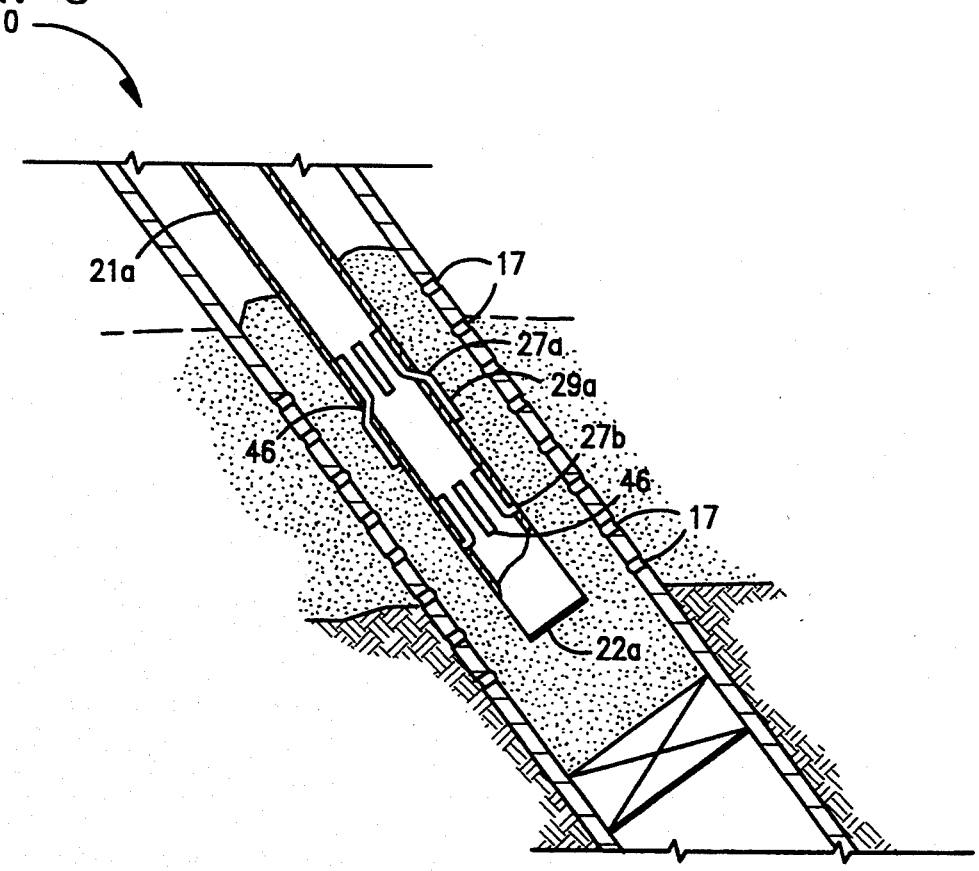
FIG. 3 is an elevational view, partly in section, of the lower end of a further embodiment of the apparatus of FIG. 1.

FIG. 3 illustrates another embodiment of a well tool **20*a* (only the lower end shown) which can be used to carry out a multiple fracture operation such as that described above. Tool 20*a* is comprised of a delivery or base conduit 21*a* which has a plurality of radial openings 46 which are spaced above the lower end 22*a* to lie within the zone(s) to be fractured. Additional openings or sets of openings (not shown) are provided in conduit 21*a* which are spaced above openings 46 whereby said openings will lie within the other zone(s) to be fractured. Basically, conduit 21*a*** is structurally similar and operates similar to that disclosed in U.S. Pat. No. 5,161,618, which is incorporated herein by reference.

Figure 4:
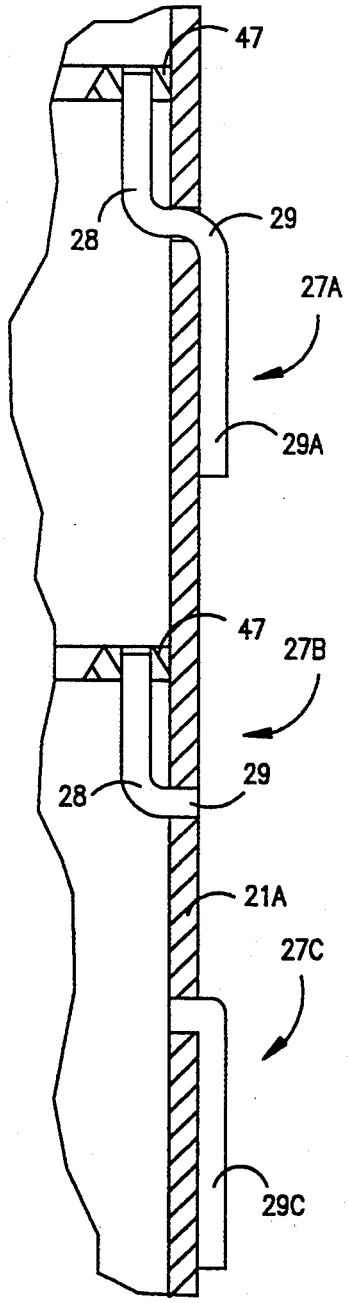
FIG. 4 is an enlarged, broken-away, sectional view of three variations of exit tubes which are used to form alternate flowpaths in a well tool in accordance with the present invention.

In accordance with the present invention, a respective exit tube **27*a*, 27*b* (FIGS. 3 and 4) is connected to each radial opening 46. Exit tubes 27*a*, 27*b* are similar in construction to those described above in that each has an inlet portion 28 and an outlet portion 29 (FIG. 4) while tubes 27*a* include an external extension portion 29*a* where desired. When a fracturing fluid is flowed through conduit 21, tubes 27*a* and/or 27*b* will divert fluid and function in the same manner as tubes 27 described above. When a wash-pipe (not shown) is lowered, it can either shear the tubes within conduit 21*a* or a guide collar 47** may be provided at each set of exit tubes to guide the wash-pipe past the exit tubes.

Further, in some instances, the entire length of an exit tube (e.g. tube **27*c* in FIG. 4) may be comprised of only exit port 28*c* and an external length or portion 29*c*. If a sand build-up occurs in the well annulus adjacent exit tube 27*c*, a column of sand will build up in the external portion 29*c* thereby blocking flow therethrough in the same manner as described above and preventing premature dehydration of the slurry within delivery tube 21*a***.

Figure 6:
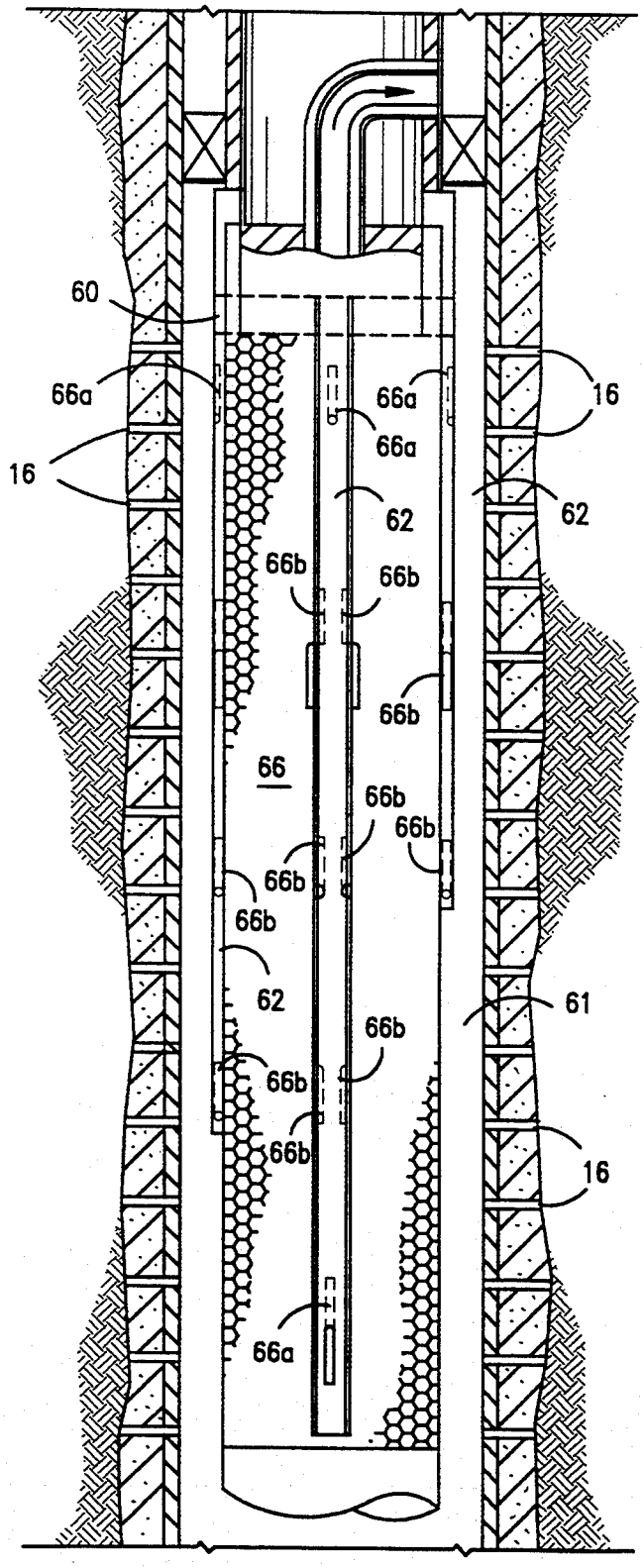
FIG. 6 is an elevational view, partly in section, of another embodiment of the gravel-pack well tool of FIG. 4.
Figure 5:
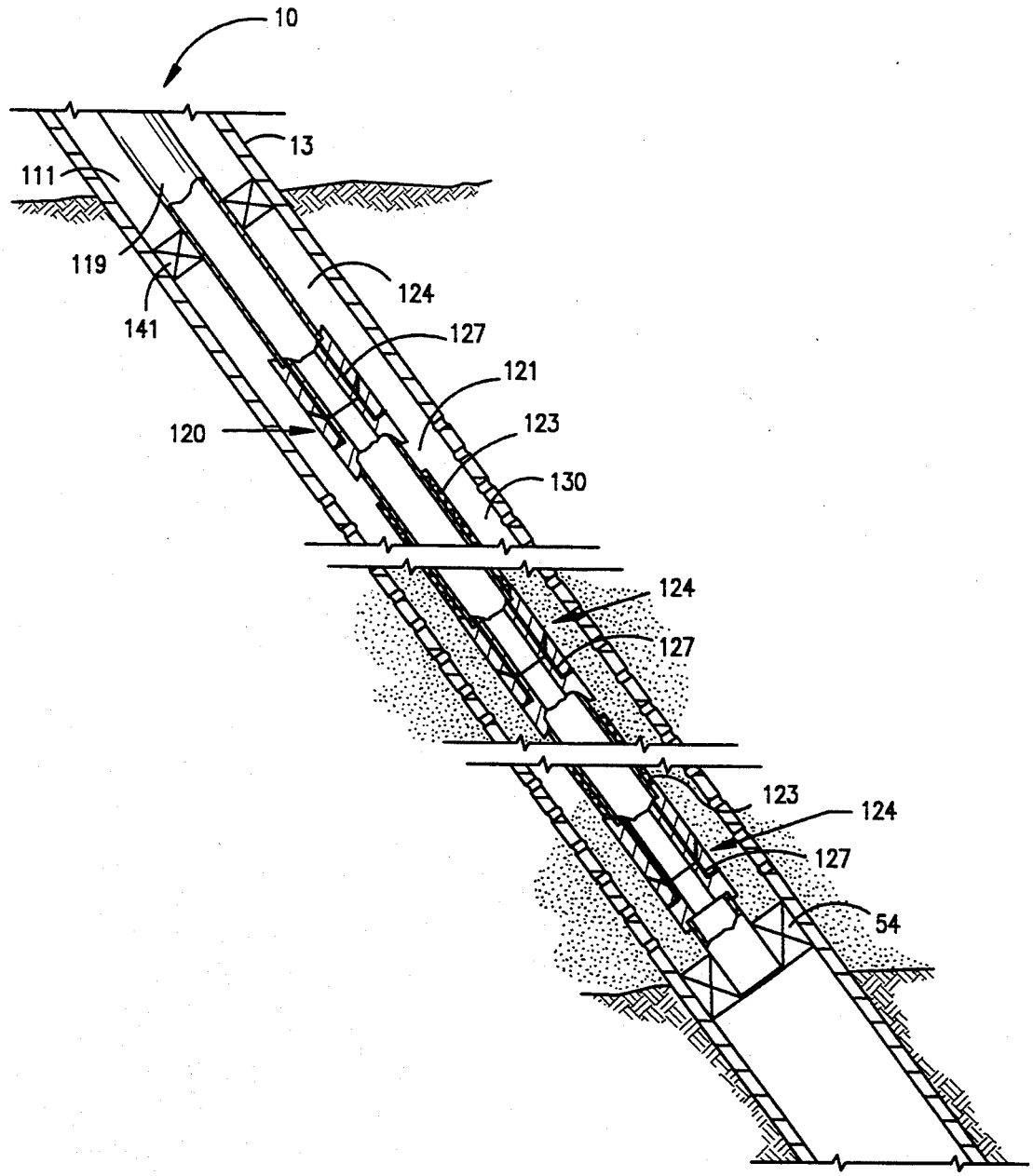
FIG. 5 is an elevational view, partly in section, of a gravel-pack well tool having alternate flowpaths in accordance with the present invention.

FIGS. 5 and 6 disclose well tools in accordance with the present invention which may be used in gravel pack well completions or in combined fracturing/gravel pack completions. These tools provides for good distribution of gravel throughout a desired completion interval even where sand bridges may form before all the gravel is deposited. Referring first to FIG. 5, well tool 120 is positioned in a wellbore 111 which has been cased and perforated. Of course, well tool 120 could be used equally as well in open-hole completions. Tool 120 is comprised of a delivery conduit 121 which, in turn, is comprised of a plurality of lengths of screen sections 123. The term "screen" is used generically herein and is meant to include and cover all types of those structures commonly used by the industry in gravel pack operations which permit flow of fluids therethrough while blocking the flow of particulates (e.g. commercially-available screens, slotted or perforated liners or pipes, screened pipes, prepacked screens and/or liners, or combinations thereof). Also, as understood in the art, blank sections (not shown) may be incorporated into delivery conduit 121 if needed in a particular application.

Figure 8:
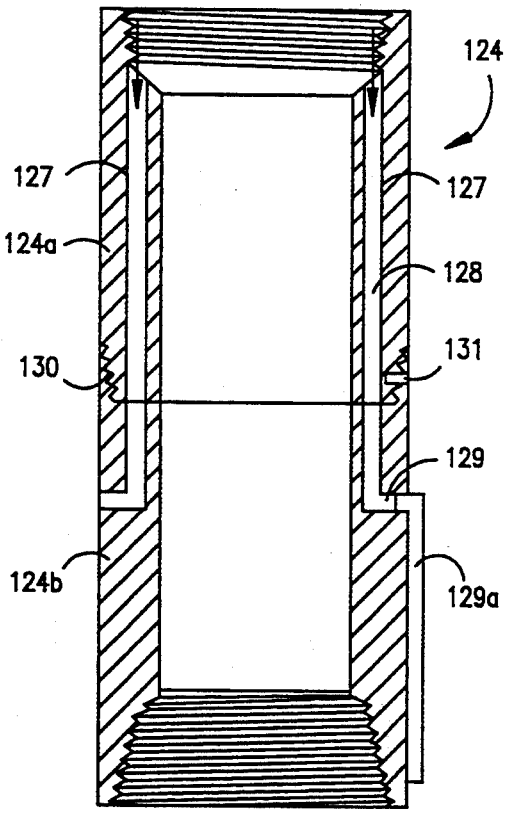
FIG. 8 is a sectional view of another embodiment of the coupling of FIG. 7.

Screen sections 123 are connected together by couplings 124 (FIG. 8). Couplings 124 may have the same basic construction as couplings 24, described above, or, as preferred, couplings 124 are made in two segments **124*a*, 124*b* which are threaded or otherwise rotatably secured together. Each coupling 124 has a plurality of exit tubes 127 therethrough which, in turn, have an inlet passage 128 and an outlet passage 129. In making up coupling 124, segments 124***a* and 124*b* are threaded to refusal and then backed-off approximately ⅛ to ¼ turn. A shear pin 131 or the like secures segments 124*a* and 124*b* in this backed-off position wherein the inlet and outlet passages are aligned to provide an open fluid flowpath therethrough.

In operation, well tool 120 is lowered into wellbore 111 on a workstring 119 and the lower end thereof is seated in landing nipple 54 and is positioned adjacent the formation to be completed. Packer 141 (which may be optional) is set and gravel slurry is pumped down workstring 119 and through well tool 120. The exit tubes 127, due to their positioning and construction, intercept and output the slurry stream at its full local sand concentration. In order to prevent excessive fluid loss from the gravel slurry through screen sections 123 as the slurry flows through tool 121, the normal size and/or number of perforations in the base pipe (about which screen is wound or positioned) is substantially reduced.

As fluid from the slurry flows outward through the production perforations which are inherently present in the delivery pipe of the screen sections into the annulus 130, the sand from the slurry will contact and quickly plug these perforations thereby blocking further flow therethrough and minimizing loss of fluid from the slurry. When the gravel pack is complete and the well is put on production, the production fluid which flows in the opposite direction into the screen will easily displace the sand from the inside of the perforations to thereby open the screen section to fluid flow.

After the gravel has been placed, exit tubes 127 in couplings 124 are closed by rotating workstring 119. Since the lower end of tool 120 is landed and held against rotation in nipple 54, rotation of workstring 119 will shear pins 131 in the respective couplings 124 which allows the respective segments 124*a* to be threaded (tightened) with respect to segements 124*b* to thereby misalign passages 128 and 129 and thereby close exit tubes 127. If couplings 24 are not made in two segments, a check valve (dotted lines 130 in FIG. 7) is provided in each of the exit tubes to allow flow out into the annulus but block reverse flow into the delivery conduit. Tubes 127 are closed after a gravel pack completion to prevent flow of sand through the exit tubes into the delivery conduit and hence, into the screened, production fluids during production.

FIG. 6 illustrates a further embodiment of a gravel pack well tool 60 in accordance with the present invention. Well tool 60 is comprised of a well screen 61 having a plurality of perforated shunts or delivery conduits 62 along the external surface of the screen which are in fluid communication with the gravel slurry as it enters the annulus in the wellbore adjacent the screen. If a sand bridge forms before all of the gravel is placed, the slurry will flow through the conduits and out into the annulus through the perforations in the shunts to complete the filling of the annulus above and/or below the bridge. For a complete description of the construction and operation of this type of gravel pack well tool, see U.S. Pat. Nos. 4,945,991 and 5,113,935, both of which are incorporated herein by reference.

In well tool 60, an exit tube 66 of the same basic type as described above is connected to a respective perforation (i.e. radial outlet) in a respective shunt 62. The exit tubes can be connected to radial outlets which exit the front of the shunt (e.g. 66*a*) or, where clearance between the tool 60 and the well casing or borewall is a problem, they can be connected to radial outlets which exit from the sides of the shunts (e.g. 66*b*). Also, extension tubes 66*c* can be utilized, if desired to extend the length of a particular exit tube. Again, since the inlet portion of each exit tube 66 lies substantially parallel to the normal flow through each of the shunts, the gravel slurry will not "dehydrate" as it flows through the shunts thereby alleviating any build-up of sand concentration within the shunts.

What is claimed is:

1. A well tool for delivering a fluid to different levels within a wellbore, said well tool comprising:

a conduit adapted to be fluidly connected to the lower end of a workstring, said conduit having a plurality of radially-opening exit ports spaced axially along said conduit whereby at least one exit port will lie adjacent a respective level within said wellbore when said well tool is in an operable position within said wellbore; and a plurality of exit tubes, one of said plurality of exit tube connected at one end to a respective one of said plurality of exit ports, each of said exit tubes having a portion whose length is substantially parallel to the longitudinal axis of said conduit.

2. The well tool of claim 1 wherein said portion of said exit tube is inside said delivery conduit and said one end of said exit tube which is connected to said exit port forms the outlet end of said tube.

3. The well tool of claim 1 wherein said portion of said exit tube is external of said delivery conduit and said one end of said exit tube which is connected to said exit port forms the inlet end of said tube.

4. The well tool of claim 2 wherein said exit tube further comprises:

a portion of exit tube having an inlet connected to said exit port and extending substantially parallel to said longitudinal axis of said delivery conduit externally of said conduit.

5. The well tool of claim 1 wherein said delivery conduit comprises:

a plurality of joints;

a plurality of couplings, each of said couplings adapted to connect two adjacent joints together and each having at least one of said exit tubes therein.

6. The well tool of claim 5 wherein each of said joints comprises:

a length of pipe.

7. The well tool of claim 5 wherein each of said joints comprise:

a length of well screen.

8. The well tool of claim 7 including:

means for closing said at least one exit tube upon completion of delivery of said fluid therethrough.

9. The well tool of claim 7 wherein each of said couplings comprise:

two segments joined together wherein said at least one exit tube is open to flow when said segments are in a first position and is closed to flow when said segments.

10. The well tool of claim 9 wherein said two segments of each coupling are threaded together and wherein said at least one exit tube comprises:

a passage through each of said two segments, the passage in one of said two segments being aligned with the passage in the other of said two segments when in said first position to thereby allow flow through said aligned passages and being misaligned with the passage in the other of said segments when in said second position to thereby block flow through said misaligned passages.

11. A well tool for delivering a fluid to different levels within a wellbore, said well tool comprising:

a conduit adapted to be fluidly connected to the lower end of a workstring, said conduit having a plurality of radially-opening exit ports spaced axially along said conduit whereby at least one exit port will lie adjacent a respective level within said wellbore when said well tool is in an operable position within said wellbore; and means within said conduit and connected to each of said exit ports for directing fluid from said conduit through said exit ports.

12. The well tool of claim 11 wherein said means for directing fluid through said exit ports comprises:

a respective exit tube within said conduit connected to each of said exit ports, each exit tube having (a) an inlet adapted to receive flow substantially parallel to the flow of said fluid in said conduit, and (b) an outlet connected to a respective exit port.

13. The well tool of claim 12 wherein each of said exit tubes comprises:

a tube having a inlet portion which is substantially parallel to the longitudinal axis of said delivery conduit and an outlet portion connected to outlet substantially perpendicular to the longitudinal axis of said conduit.

14. The well tool of claim 13 wherein said conduit comprises:

a plurality of joints;

a plurality of couplings, each of said couplings adapted to connect two adjacent joints together and each having at least one of said exit tubes formed therein.

15. The well tool of claim 14 wherein each of said joints comprises:

a length of pipe.

16. The well tool of claim 14 wherein each of said joints comprises:

a length of well screen.

17. The well tool of claim 14 wherein each of said couplings comprises:

two segments joined together wherein said at least one exit tube is open to flow when said segments are in a first positon and is closed to flow when said segments are in a second position.

18. The well tool of claim 15 including:

means for unloading said tool.

19. The well tool of claim 17 wherein said two segments of each coupling are threaded together and wherein said at least one exit tube comprises:

a passage through each of said two segments, the passage in one of said two segments being aligned with the passage in the other of said two segments when in said first position to thereby allow flow through said aligned passages and being misaligned with the passage in the other of said segments when in said second position to thereby block flow through said misaligned passages.

* * * * *

UNITED STATES PATENT AND TRADEMARK OFFICE

CERTIFICATE OF CORRECTION

PATENT NO. : 5,419,394

DATED : May 30, 1995

INVENTOR(S) : Lloyd G. Jones

It is certified that error appears in the above-indentified patent and that said Letters Patent is hereby corrected as shown below:

Col. 8, line 61, Claim 9, after "segments." insert --are in a second position--.

Signed and Sealed this

Fourteenth Day of November, 1995

Bruce Lehman

*Attest:*

BRUCE LEHMAN

*Attesting Officer*

*Commissioner of Patents and Trademarks*